US005223685A

United States Patent [19]

DeRienzo, Jr.

[11] Patent Number: 5,223,685

[45] Date of Patent: Jun. 29, 1993

[54] ELEVATED MICROWAVE COOKING PLATFORM

[76] Inventor: Joseph R. DeRienzo, Jr., 6420 Alabama, St. Louis, Mo. 63111

[21] Appl. No.: 502,992

[22] Filed: Apr. 2, 1990

[51] Int. Cl.[5] ..... H05B 6/80

[52] U.S. Cl. ..... 219/10.55 E; 99/DIG. 14; 99/444; 426/113; 426/243; 426/110

[58] Field of Search ..... 219/10.55 E, 10.55 F, 219/10.55 R; 99/DIG. 14, 451, 444; 426/107, 109, 113, 110, 118, 241, 243, 234

[56] References Cited

U.S. PATENT DOCUMENTS

| | | | |
|---|---|---|---|
| 4,228,945 | 10/1980 | Wysocki | 219/10.55 E |
| 4,249,464 | 2/1981 | Hansen | 219/10.55 E |
| 4,260,060 | 4/1981 | Faller | 99/DIG. 14 |
| 4,369,346 | 1/1983 | Hart et al. | 219/10.55 E |
| 4,450,334 | 5/1984 | Bowen et al. | 219/10.55 E |
| 4,505,391 | 3/1985 | Kuchenbecker | 219/10.55 E |
| 4,539,455 | 9/1985 | Colato et al. | 219/10.55 E |
| 4,555,605 | 11/1985 | Brown et al. | 219/10.55 E |
| 4,592,914 | 6/1986 | Kuchenbecker | 426/107 |
| 4,594,492 | 6/1986 | Maroszek | 219/10.55 E |
| 4,633,052 | 12/1986 | Beavers et al. | 219/10.55 E |
| 4,705,929 | 11/1987 | Atkinson | 219/10.55 E |
| 4,728,762 | 3/1988 | Roth et al. | 219/10.55 E |
| 4,745,249 | 5/1988 | Daniels | 219/10.55 E |
| 4,826,072 | 5/1989 | Hart | 426/109 |
| 4,862,791 | 9/1989 | Baughey | 426/107 |
| 4,877,932 | 10/1989 | Bernstein et al. | 219/10.55 E |
| 4,950,524 | 8/1990 | Hacker | 219/10.55 E |

*Primary Examiner*—Philip H. Leung
*Attorney, Agent, or Firm*—Rogers, Howell & Haferkamp

[57] ABSTRACT

A cooking utensil for microwave cooking foods includes a horizontal base with a cooking surface and a bottom surface, and a plurality of pores and/or openings extending through the base between the two surfaces. A plurality of support legs support the base in a horizontal position on a bottom oven wall of a microwave oven. The base and the plurality of support legs are constructed of a moisture absorbent material that absorbs moisture from foods supported by the cooking utensil and cooked by microwave.

6 Claims, 2 Drawing Sheets

FIG. 1.
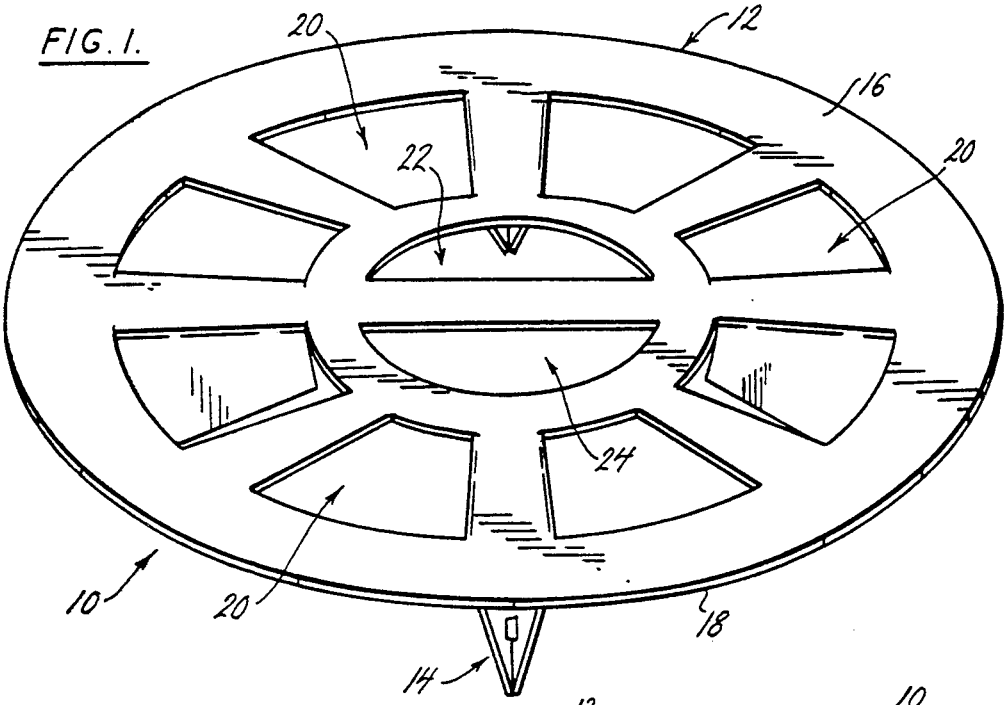
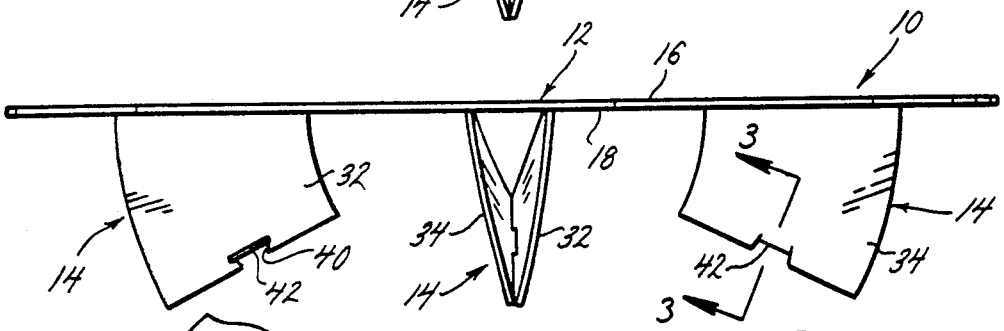
FIG. 2.
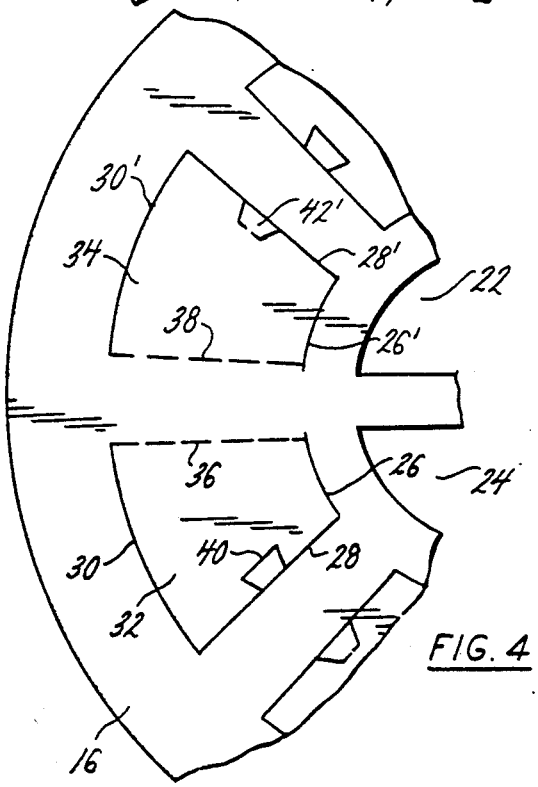
FIG. 4.
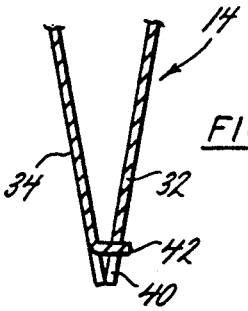
FIG. 3.

FIG. 5.
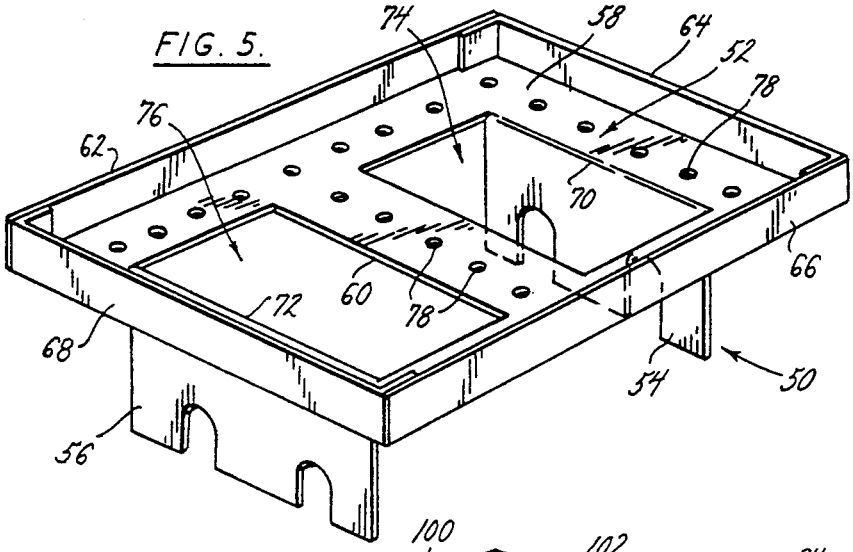
FIG. 6.
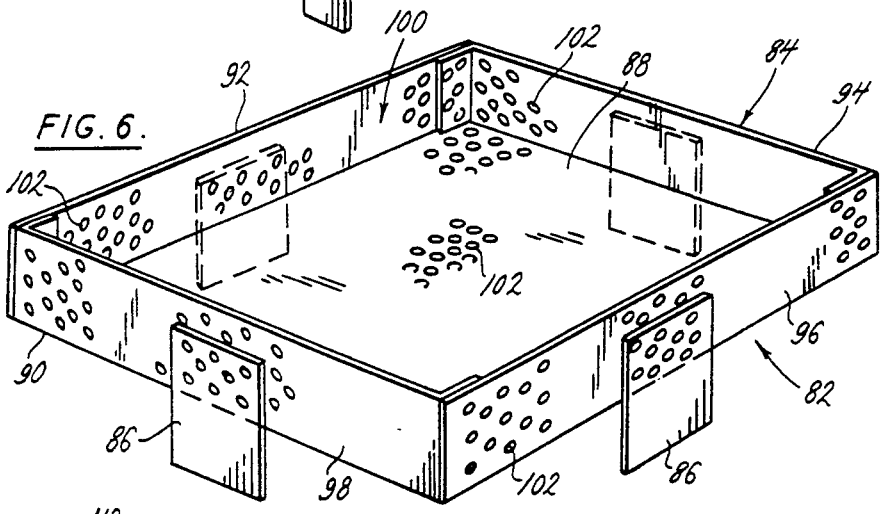
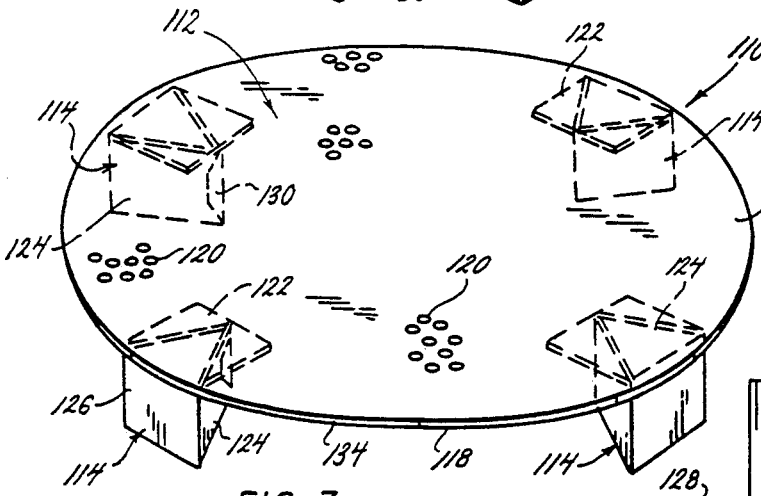
FIG. 7.
FIG. 8.
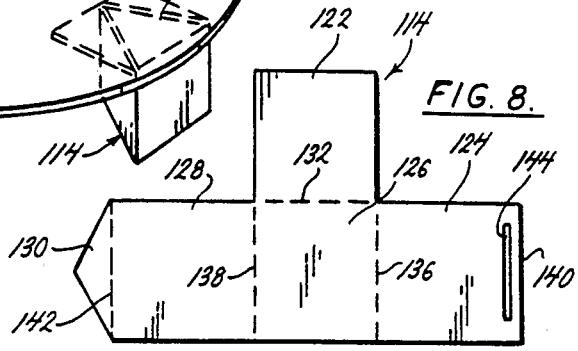

ELEVATED MICROWAVE COOKING PLATFORM

BACKGROUND OF THE INVENTION (1) Field of the Invention

The present invention relates to elevated microwave cooking utensils, in particular an inexpensive elevated paperboard cooking platform provided with a series of pores or larger openings in its cooking surface that provide direct contact between food supported on the platform and air beneath the platform, and that enable the platform to be used in the microwave cooking of foods prepared specifically for cooking in conventional convection heating and conduction heating ovens, in addition to cooking foods prepared specifically for cooking in microwave ovens.

(2) Description of the Related Art

Prior art microwave cooking utensils are currently designed, for the most part, for use in cooking microwavable foods or foods prepared specifically for microwave cooking. Many of these utensils are inexpensive and are made a part of the packaging of the microwavable food, or are included in the packaging. Many utensils serve only to elevate the food in the microwave oven and do nothing to reduce the sogginess, or improve the appearance or texture of the food. Some more expensive microwave cooking utensils include features that improve the appearance and/or the texture of microwave cooked foods. Utensils of this type commonly include a metallic microwave interactive layer that converts microwave energy into heat. These metallic layers become extremely hot when subjected to microwaves and, in effect, fry foods placed on the layers in much the same manner as a heated skillet. The heat produced by the interactive layer of these utensils evaporates only a relatively small amount of the moisture emitted from the microwave cooked foods. Evaporation of moisture is important as it reduces the sogginess or doughy texture that is a common attribute of microwave cooked foods, especially foods comprising doughs, such as pizza. The heat given off by the microwave interactive layer of conventional utensils is also used in browning some foods to improve their texture, for example, browning the crust of pizza.

However, providing a metallic microwave interactive layer on cooking utensils of the type included with the packaging of food has the drawback of substantially increasing the cost of the packaging.

Moreover, the metallic microwave interactive layer retains heat and is often still quite hot when the packaging is removed from the microwave oven after cooking. The heated metallic layer on these packages can cause burns if the package is not handled cautiously.

Furthermore, no matter what particular features a conventional microwave utensil may comprise, to obtain good results in cooking by microwave, it is advisable to use food products specifically produced for cooking by microwave. Despite the beneficial features that have been incorporated into conventional microwave cooking utensils, up to this time, no microwave cooking utensil has been developed that is capable of microwave cooking foods prepared for cooking in conventional ovens such as conduction or convection heating ovens, as well as cooking foods specifically prepared for cooking by microwave. This is because conventional food recipes, or recipes that have not been specifically prepared for microwave cooking, commonly contain ingredients that are not well suited for cooking by microwave. Examples of these ingredients are yeast and other leavening agents.

Yeast doughs and yeast containing products are not suited to be cooked by microwave because the combination of heat and moisture produced in the foods cooked by microwave reactivates the yeast, causing the yeast to soften and the dough or food product containing the yeast to break apart. To overcome this problem, some excess moisture in the food must be removed as the food cooks. In conventional ovens, the heat in the air surrounding the food causes much of the moisture produced by the cooking food to evaporate. In microwave cooking, the air surrounding the food is not heated and only the heat of the food itself causes a small portion of the moisture produced by the cooking food to evaporate. To compound the problem, microwave ovens are sealed to a greater extent than conventional ovens, and a large portion of the moisture that evaporates from microwave cooked foods is prevented from leaving the oven interior.

The elevated microwave cooking platform of the present invention overcomes the disadvantages found in prior art microwave cooking utensils, by providing a microwave cooking utensil that is constructed entirely of paperboard and is therefore inexpensive, it does not significantly interact with microwaves nor does it retain sufficient heat to cause burns, and it is readily incorporated into packaging material or included as part of the packaging of food. Furthermore, the absorbency of the paperboard construction of the cooking platform of the present invention combined with its structural configuration together adapt the platform to be used in microwave cooking foods prepared for cooking in conventional heat conduction and convection heating ovens, as well as in cooking foods specifically prepared for microwave cooking, by removing some of the moisture produced by the microwave cooked food from the surrounding environment of the food.

It is therefore an object of the present invention to provide a microwave cooking utensil that is inexpensive paperboard and is designed to be included in the packaging of food, that adapts food specifically prepared for cooking by conventional conduction and convection heating ovens to cook by microwave and improves the results obtained in cooking microwavable food by removing moisture from the food and its surroundings as it cooks.

SUMMARY OF THE INVENTION

The elevated microwave cooking platform of the present invention is generally comprised of a horizontal cooking base or platform, and a plurality of support legs provided beneath the platform.

The support legs elevate the platform and position food placed on the platform in an elevated position in a microwave oven in which the platform of the invention is used. The support legs elevate the food to a greater extent than some prior art platforms to provide more room for air to circulate beneath the platform and the food supported on the platform.

The cooking platform itself is a generally flat platform supported in a horizontal position above the bottom of a microwave oven by the support legs. The horizontal platform has several different configurations, to suit the platform to cooking several different types of foods. In one embodiment, the platform has a circular periphery to adapt the platform for supporting and microwave cooking pizzas. In another embodiment the platform has a rectangular periphery for use in supporting and microwave cooking cookies and other similar foods. In a still further embodiment of the platform, a vertically extending wall surrounds the peripheral edge of the platform. This embodiment of the invention is suited to cooking cake mixes and other similar foods that are poured onto the platform and are retained on the platform by the surrounding vertical walls.

In each of the embodiments of the cooking platform, the cooking platform is constructed entirely of paperboard and is also provided with a series of small pores or larger openings extending through the platform to the air circulating beneath the platform. The pores or larger openings expose substantial areas of the food supported by the platform. The moisture and vapor that is emitted from the food as it cooks by microwave separates from the food by evaporation, and by passing through these pores and openings. In this manner, the pores and openings serve to eliminate a good portion of the sogginess commonly attributed to microwave cooked foods. Where some paperboard microwave cooking utensils of the prior art would trap moisture between the cooking surface of the utensil and the food being cooked by microwave, the pores and openings of the paperboard cooking platform distinguish the present invention over the prior art by permitting the moisture and vapors emitted from the microwave cooked foods to escape through the pores and openings and separate from the microwave cooked foods.

The paperboard construction of the cooking platform does not interact with microwaves or retain appreciable heat, and unlike prior art paperboard cooking utensils with metallic microwave interactive layers, does not present the danger of causing burns when the platform is removed from the oven. The paperboard serves to remove some of the moisture, oils, and vapor emitted by microwave cooked foods supported by the platform by absorbing some of the moisture, oil, and vapor directly into the paperboard of the platform where the platform contacts the food. This absorption by the paperboard also eliminates some of the sogginess attributed to microwave cooked foods.

By its absorption of the moisture, oils, and vapor emitted from foods cooked by microwave, and by its enabling some moisture, oils, and vapor to separate from the food by passing through the openings in the platform the paperboard cooking platform of the present invention is capable of microwave cooking foods prepared for cooking in conventional heat conduction and convection heating ovens, as well as cooking foods specifically prepared for microwave cooking.

BRIEF DESCRIPTION OF THE DRAWINGS

Further objects and features of the present invention are revealed in the following detailed description of the preferred embodiments of the invention and in the drawing figures wherein:

FIG. 1 is a perspective view of a first embodiment of the present invention;

FIG. 2 is a side elevation view of the first embodiment of the invention;

FIG. 3 is a view in section of a support leg of the present invention taken along the line 3—3 of FIG. 2;

FIG. 4 is a plan view in section of the first embodiment of the invention;

FIG. 5 is a perspective view of an additional embodiment of the invention;

FIG. 6 is a perspective view of a further embodiment of the present invention;

FIG. 7 is a perspective view of a still further embodiment of the present invention; and FIG. 8 is a plan view of a support leg blank for the platform support legs shown in FIG. 7.

DESCRIPTION OF THE PREFERRED EMBODIMENTS

FIG. 1 shows a first embodiment of the elevated microwave cooking platform 10 of the present invention. This embodiment of the invention is best suited for the microwave cooking of foods such as pizzas, and is generally comprised of a base portion 12 and a plurality of leg supports 14.

The base portion 12 is generally circular and has a top cooking surface 16 and a bottom surface 18. A plurality of outer openings 20 are formed in the base portion and extend between the top surface 12 and the bottom surface 18. The outer openings 20 are spatially arranged around two semi-circular center openings 22, 24. The outer openings 20 surrounding the two center openings 22, 24 are formed by cutting flaps in the base portion of the cooking platform, and folding the flaps downward to form the leg supports 14 of the platform. Each opening of the plurality of openings 20, 22, 24 defines an open are within the peripheral boundary of the top surface 12. The total area of the open areas defined by the openings 20, 22, 24 is at least as large as a total surface area of the top surface 12 of the support means.

As best seen in FIGS. 2–4, an adjacent pair of outer openings 20 are formed by first cutting along three sides 26, 28, 30, 26', 28', 30' of a first and a second flap 32, 34, and then folding the flaps downward along fold lines 36, 38, respectively. As the flaps or folded downward along their fold lines, they form the openings 20 in the base portion 12 of the platform. Each opposed flap of a pair of flaps with adjacent fold lines has either a dove tailed notch 40 or a dove tailed tab 42 cut in its free edge 28, 28' opposite its fold line 36, 38. The opposed flaps are folded downward until their free edges are brought against each other. The dove tailed tab 42 of the second flap is then inserted into the dove tailed notch 40 of the first flap to secure the first and second flaps of the leg support 14 in their assembled condition.

In the embodiment of the invention shown in FIG. 1, four leg supports 14 spatially arranged around the bottom 18 of the cooking platform are assembled from four pairs of flaps cut into the base portion 12 of the platform. Before the leg support flaps are folded downward, the platform 10 is generally flat and can be packaged along with some food products, such as pizza, that it is intended to support by incorporating the flat platform into the packaging of the food or by including the platform in the food packaging. With each opposed pair of flaps assembled into a leg support 14 depending from the base portion 12, the first embodiment of the microwave cooking platform of the present invention is ready for use in supporting a food product horizontally above the bottom of a microwave oven. The support legs elevate the food supported on the platform to a greater extent than some prior art platforms to provide increased air circulation beneath the food supported on the platform.

The cooking platform of FIG. 1 is constructed completely of paperboard. The paperboard is inexpensive, it does not absorb or interfere with microwaves, and it does not retain sufficient heat to present a danger of causing burns. The paperboard of the top cooking surface 16 of the platform will absorb a certain amount of moisture, oil, and vapor emitted from the food supported on the top surface as the food is cooked by microwave. The plurality of openings 20, 22, 24 will permit a certain amount of moisture, oil and vapor emitted from the cooking food to pass through the openings and separate from the food. The openings also expose portions of the bottom surface of the food directly to the air circulating beneath the platform, thereby enabling the evaporation of moisture, oil, and vapor from the bottom surface of the food. In this manner, a substantial portion of the moisture, oil, and vapor created by microwave cooking foods both prepared for cooking in conventional ovens and prepared for cooking in microwave ovens will be evaporated or absorbed into the platform supporting the food, thereby substantially eliminating the problem of sogginess commonly attributed to microwave cooked foods.

FIG. 5 shows a further embodiment of the elevated microwave cooking platform of the present invention. In this embodiment, the cooking platform 50 is also constructed completely of paperboard, and is generally comprised of a base portion 52, and a pair of leg supports 54, 56.

The base portion is rectangular and has a top cooking surface 58 and a bottom surface 60. As in the first embodiment, the paperboard top cooking surface 58, will absorb a certain amount of moisture, oil, and vapor emitted from the food supported on the surface as the food cooks. Four side walls 62, 64, 66, 68 surround and extend vertically upward from the peripheral edge of the base portion 52. The side walls serve to maintain the position of the food supported on the base portion 52 relative to the base portion.

As in the first embodiment, the support legs 54, 56 are cut in the base portion 52 of the platform, and are folded downward along fold lines 70, 72 to their operative positions shown in FIG. 5. The support legs elevate the base portion, and provide ample room for air to circulate beneath the food supported by the base portion. With the legs 54, 56 folded downward to their operative positions, a pair of openings 74, 76 are formed in the base portion 52 of the platform. The series of large openings 74, 76 have a combined open are at least as large as the area of the top surface 58 of the platform. As in the first embodiment, the openings permit the escape of moisture, oil and vapors from the food as it is cooked by microwave, the moisture, oil, and vapor being evaporated by the air circulated beneath the base portion, and also being separated from the food by passing through the openings 74, 76. A plurality of pores 78, are also provided in the base portion extending between the top surface 58 and the bottom surface 60. The pores 78 also permit the escape of moisture, oil and vapors from the food as it is cooked by microwave in much the same manner as the larger openings 74, 76.

With the legs folded up flush with the base, this embodiment of the cooking platform forms a compact, protective surrounding for the food contained on the platform. This embodiment of the invention is well suited to be included as part of the packaging of foods, especially food products that are dispensed by vending machines and then heated by microwave.

A still further embodiment of the invention is shown in FIG. 6. The FIG. 6 embodiment 82 is best suited for the microwave cooking of food products such as cake mixes. This embodiment is also constructed completely of paperboard, and is generally comprised of a base portion 84 and four leg supports 86.

The base portion 84 includes a top cooking surface 88 and a bottom surface 90. Four vertical side walls 92, 94, 96, 98 extend upward from and completely surround the peripheral edge of the top surface of the base portion. Together, the side walls 92, 94, 96, 98 and the top surface 88 of the base portion 84 define a pan interior 100 of the cooking platform 82. A plurality of pore openings 102 extend through the base portion 84 and the side walls 92, 94, 96, 98. The pores communicate the pan interior 100 with the exterior of the platform, and function as the openings and pores of the previously described embodiments. Each individual pore 102 is dimensioned to permit passage through the pore of moisture and/or vapors emitted from foods contained in the pan interior and cooked by microwave. However, the pores are also dimensioned so small that fluids of any appreciable viscosity will not leak through the pores.

The four support legs 86 are secured by adhesive or other means to the side walls of the platform 82, and support the base portion 84 of the platform in a horizontal position above the bottom of a microwave oven. The legs are dimensioned to provide ample room beneath the base portion for the free circulation of air.

Foods cooked by microwave in the cooking platform 82 of this third embodiment will also emit moisture, oil and vapors as they are cooked. A portion of the emitted absorbed directly into the cooking surface 88 of the base portion 84, and into the sidewall surfaces which contact the food placed in the pan interior 100. An additional portion of the moisture, oil and vapors emitted from the cooking food passes through the plurality of pores 102 in the base portion 84 and sidewalls 92, 94, 96, 98, and is evaporated by air circulating around the platform or is otherwise separated from the food. In this manner, this embodiment of the invention is capable of permitting the escape from foods of a substantial amount of moisture, oil and vapor produced when the cooking platform is used to cook conventional foods by microwave.

FIG. 7 shows a still further embodiment of the elevated microwave cooking platform of the present invention. The platform embodiment 110 shown in FIG. 7 is constructed completely of paperboard, and is comprised of a horizontal base portion 112 and four support legs 114 that support the base portion in a horizontal position. This embodiment of the invention is best suited for the microwave cooking of foods such as cookies.

The base portion is shown as being circular, but may also be rectangular, although the circular base is better suited for use in a microwave oven with a rotisserie. The base portion includes a top cooking surface 116 and a bottom surface 118. As in previously described embodiments, a plurality of pores 120 are formed in the base portion 112 and extend between the top surface 116 and the bottom surface 118. Again, the pores function as the openings and pores of the previously described embodiments, and are dimensioned to permit the passage through the pores of moisture, oil, and vapors emitted from foods supported on the top cooking surface 116 of the platform and cooked by microwave. However, the pores 120 are not dimensioned so large that fluid of any appreciable viscosity is capable of passing through the pores.

The four support legs 114 are formed from the paperboard blank shown in FIG. 8. The blank is comprised of a glue flap 122, first, second, and third sidewalls 124, 126, 128, and a connecting tab 130. In assembling each support leg, the glue flap 122 is first glued to the bottom surface 118 of the platform with the fold line 132 positioned adjacent the peripheral edge 134 of the platform. Next, the sidewalls and tab 124, 126, 128 and 130, are folded downward at the fold line 132, until they are perpendicular to the platform bottom surface 118. Next, the tab 130, the first sidewall 124, and the third sidewall 128, are folded inward at the fold lines 136, 138 until the free edge 140 of the first sidewall 124 contacts the fold line 142 between the third sidewall 128 and the tab 130. The tab is then folded over at its fold line 142 and inserted into the slot 144 in the first sidewall 124 to complete the assembly of the support leg. The support legs support the base portion 112 of the platform in a horizontal position above the bottom of a microwave oven, and are dimensioned to provide ample room beneath the base portion for the free circulation of air. The support legs of the FIG. 7 embodiment constructed from the blank of paperboard shown in FIG. 8 may also be used with the FIG. 6 embodiment of the invention in lieu of the support legs 86 shown in that Figure.

As moisture, oil and vapor are emitted from cooking foods supported on the top surface 116 of the base portion 112, a portion of the moisture, oil and vapor is absorbed into the paperboard of the top surface 116 in contact with the food. A certain amount of moisture, oil and vapor emitted from the food as it cooks will pass through the plurality of pores 120 and will be evaporated by the air circulating beneath the platform or will otherwise separate from the food. In this manner, a substantial portion of the moisture, oil and vapor produced by microwave cooked food supported by the platform 110 is either evaporated or absorbed into the platform.

While the embodiments of the invention have been described above as being constructed completely of paperboard, it should be understood that the platform of the present invention can be constructed in whole or in part from other materials having similar strength and absorption properties to that of paperboard without departing from the intended scope of the invention. Likewise, the platform can be constructed in a different configuration other than those of the described embodiments without departing from the intended scope of the invention.

While the present invention has been described by reference to specific embodiments, it should be understood that modifications and variations of the invention may be constructed without departing from the scope of the invention defined in the following claims.

What is claimed is:

1. A cooling utensil for microwave cooking foods prepared specifically for cooking in convection heating ovens and conduction heating ovens in addition to cooking foods prepared specifically for cooking in microwave ovens, the utensil comprising:

a food support means having a top surface with a plurality of openings therein, the top surface being adapted to support food within a microwave oven;

elevating means adapted to elevate the support means a sufficient distance above a bottom of a microwave oven to permit a free flow of air beneath the support means and the food supported by the support means;

the top surface of the support means being constructed of a moisture absorbent material, adapting the top surface of the support means to readily absorb moisture, oils and vapors into the material that egress from food supported on the top surface and cooked by microwave, and the plurality of openings in the top surface providing direct contact between the food and the air beneath the support means, and enabling the moisture, oil and vapor egressing from the food to evaporate or pass through openings of the plurality of openings away from the food; and, the elevating means including at least one spacer leg formed integrally with the support means from tabs cut into the support means, the tabs being pressed downward from the top surface out of the support means and depending below the top surface, the plurality of openings in the top surface being formed by the tabs cut and pressed downward.

2. The cooking utensil of claim 1 comprising:

the plurality of openings including a series of pores in the top surface, the pores being dimensioned to enable passage through the pores of moisture, oil and vapor egressed from food supported over the pores by the top surface and cooked by microwave.

3. The cooking utensil of claim 2 comprising:

the support means including at least one vertical side wall extending upward from a peripheral edge of the top surface, the side wall and the top surface together defining a baking pan, a series of pores extending through the side walls, the pores being dimensioned to enable passage through the pores of moisture and vapor egressed from food supported in the defined pan and cooked by microwave.

4. A cooking utensil for microwave cooking foods prepared specifically for cooking in convection heating ovens and conduction heating ovens in addition to cooking foods prepared specifically for cooking in microwave ovens, the utensil comprising:

a cooking platform having a top cooking surface adapted to support food cooked by microwave, and a plurality of openings extending through the cooking platform;

a platform support means adapted to support the platform horizontally above a bottom of a microwave oven, enabling a free flow of air beneath the platform and the food supported on the cooking surface;

the cooking platform being constructed of paperboard, adapting the top surface to readily absorb into the platform moisture, oils and vapors egressed from food supported on the top surface and cooked by microwave, the plurality of openings in the platform providing direct contact between the food supported by the platform and the air beneath the platform, enabling the moisture, oils and vapors egressed from the food placed over the plurality of openings to evaporate or pass through the openings and away from the food;

the plurality of openings including a series of pores extending through the platform, each pore of the plurality being dimensioned to enable the passage through the pore of moisture, oils, and vapor emitted from food supported by the platform and cooked by microwave; and, the cooking platform having at least one vertical side wall extending upward from a peripheral edge of the platform top surface, the side wall and the platform together defining a baking pan, and a series of pores extending through the side wall, the pores each being dimensioned to enable the passage through the pores of moisture, oils, and vapor emitted from food supported by the platform and cooked by microwave.

5. The cooking utensil of claim 4 comprising:

the plurality of openings including a series of large openings arranged within a peripheral boundary of the cooking platform, the series of large openings having a combined open area at least as large as the top surface area of the platform.

6. The cooking utensil of claim 4 comprising:

the platform support means including at least one support leg formed integrally with the platform by a plurality of tabs cut into the platform, the tabs being pressed downward from the top surface of the platform and depending below the platform, the plurality of openings in the platform being formed by the plurality of tabs cut in the platform and pressed downward out of the platform.

* * * * *